US006914577B2

(12) United States Patent
McCandless

(10) Patent No.: US 6,914,577 B2
(45) Date of Patent: Jul. 5, 2005

(54) SYSTEM AND METHOD FOR IMPROVING ANTENNA PATTERN WITH A $TE_{20}$ MODE WAVEGUIDE

(75) Inventor: Jay McCandless, Durham, NC (US)

(73) Assignee: Harris Broadband Wireless Access, Bellevue, WA (US)

( * ) Notice: Subject to any disclaimer, the term of this patent is extended or adjusted under 35 U.S.C. 154(b) by 98 days.

(21) Appl. No.: 10/424,859

(22) Filed: Apr. 29, 2003

(65) Prior Publication Data

US 2004/0217913 A1 Nov. 4, 2004

(51) Int. Cl.[7] ..... H01Q 1/52
(52) U.S. Cl. ..... 343/841; 343/844; 343/776
(58) Field of Search ..... 343/772, 776, 343/841, 844, 867, 700 MS

(56) References Cited

U.S. PATENT DOCUMENTS 4,749,973 A 6/1988 Kaneko et al. ..... 333/210
4,985,708 A * 1/1991 Kelly ..... 343/771
5,767,813 A * 6/1998 Verma et al. ..... 343/744
6,046,702 A * 4/2000 Curtis et al. ..... 343/776
6,185,354 B1 * 2/2001 Kronz et al. ..... 385/129
6,501,439 B2 * 12/2002 Keilen ..... 343/895

* cited by examiner

*Primary Examiner*—Don Wong
*Assistant Examiner*—Jimmy Vu
(74) *Attorney, Agent, or Firm*—Duane Morris LLP

(57) ABSTRACT

An isolation shield improves the F/B ratio for a directional antenna radiating a electromagnetic wave with a wavelength of $\lambda_{XMT}$ with a $TE_{20}$ mode waveguide. The system includes a directional antenna and a waveguide adapted for attachment to one side of the directional antenna. The waveguide defines a channel spanning and positioned adjacent to the side of the directional antenna. The channel has a width and depth that are functions of $\lambda_{XMT}$. The waveguide excites a null in the E-field within the channel. The null being adjacent to the edge of the directional antenna and thereby improving the F/B ratio of the directional antenna.

50 Claims, 4 Drawing Sheets

SYSTEM AND METHOD FOR IMPROVING ANTENNA PATTERN WITH A $TE_{20}$ MODE WAVEGUIDE

BACKGROUND

Microwave and millimeter wave systems commonly use space diversity and frequency reuse in order to more efficiently provide coverage over a service area. In such systems the space diversity and frequency reuse can be accomplished with directional antennas, as such the system's operation is greatly impacted and dependent upon the patterns formed by the directional antenna. Signals propagating or existing outside the desired antenna direction or pattern can degrade system performance. Signals originating from behind or the back hemisphere of antenna are usually coupled into the antenna by signals scattering off of the outside edge of the antenna. The strength of these spurious signals relative to the desired signals is commonly characterized as the F/B ratio (the radiated energy from the front/the radiated energy from the back), where the larger value is more desirable, at least for directional antennas.

Previous solutions to reducing these spurious signals and improving F/B ratio and thus the overall efficiency of a system, have used adjacent waveguides sized to allow the propagation of the $TE_{10}$ mode only. These solutions used the waveguides as chokes to create nulls in space that are not oriented along the outside edge where the leaked E-Field is propagated out away from the edge but not nulled along the edge of the antenna. Other previous solutions include the use of absorbers to attenuate the signals propagating from the side and around the back of antennas, or large metallic shields in an effort to increase the F/B ratio. However, in addition to the fact these approaches are generally less effective, these approaches require waveguides, absorbers, and/or shields that are of considerable size often on the order of many wavelengths $\lambda$. As directional antennas are usually clustered at a hub positioned at a substantial height above the ground, dimensional size and weight are by no means a trivial matter. Thus there is a need to more effectively increase the F/B ratio in direction antennas without substantially increasing the dimensional size, weight and complexity.

In order to obviate the deficiencies of the prior art as describe above, it is an object of the disclosed subject matter to provide a novel isolation shield for improving F/B ratio for a directional antenna radiating a electromagnetic wave with a wavelength of $\lambda$. The system including a waveguide adapted for attachment to at least one side of the directional antenna, the waveguide defining a channel spanning and positioned adjacent to a side of the directional antenna. The channel having a width as a function of $\lambda_{XMT}$, thus providing a null E-field within the channel that is adjacent to an edge of the directional antenna. The isolation shield thereby improving the F/B ratio of the directional antenna.

It is another object of the disclosed subject matter to provide a novel directional antenna system configured for radiating a $c/\lambda$ Hertz signal, where c is generally the speed of light. The directional antenna system including a directional antenna defined by an outer edge and a waveguide adjacent to the outer edge. The waveguide is configured to excite a $TE_{20}$ mode at an wavelength $\lambda$ within the waveguide.

It is still another object of the disclosed subject matter to provide an improved method for improving the F/B ratio for a directional antenna with an adjacent waveguide. The directional antenna configured to radiate a $\lambda$ wavelength signal. The improvement comprising: dimensioning the waveguide to excite a $TE_{20}$ mode for the $\lambda$ wavelength signal and creating a null, along the edge of the directional antenna, in an E-field leaked from the antenna.

It is yet another object of the disclosed subject matter to provide an antenna cluster with an improved antenna pattern. The antenna cluster having at least two co-located directional antenna systems, one configured for radiating a $c/\lambda_1$ hertz signal in one direction and another configured for radiating a $c/\lambda_2$ hertz signal in another direction. In the antenna cluster one of the antenna systems comprises a directional antenna defined by an outer edge and a waveguide adjacent to the outer edge of the antenna. The waveguide is dimensioned to excite a TE 20 mode at an wavelength $\lambda_2$, of the other antenna, within the waveguide.

It is also an object of the disclosed subject matter to provide a novel directional antenna system configured for radiating a horizontally polarized signal with at $c/\lambda$ hertz. The direction antenna system including a directional panel antenna defined by an outer edge for radiating the signal, the outer edge formed by two side edges, a top edge and a bottom edge. The directional antenna system also includes a waveguide adjacent to one of the two side edges and forming a channel parallel to the side edge. The waveguide is dimensioned to excite a TE 20 mode within the channel for $\lambda$ wavelength signal.

The disclosed subject matter presents embodiments with simple waveguide elements that can be designed in or added on to an existing antenna to substantially improve the antenna performance, especially the F/B ratio without the associated drawbacks of the prior art.

These and many other objects and advantages of the disclosed subject matter will be readily apparent to one skilled in the art to which the disclosure pertains from a perusal or the claims, the appended drawings, and the following detailed description of the preferred embodiments.

DETAILED DESCRIPTION OF THE INVENTION

Figure 1:
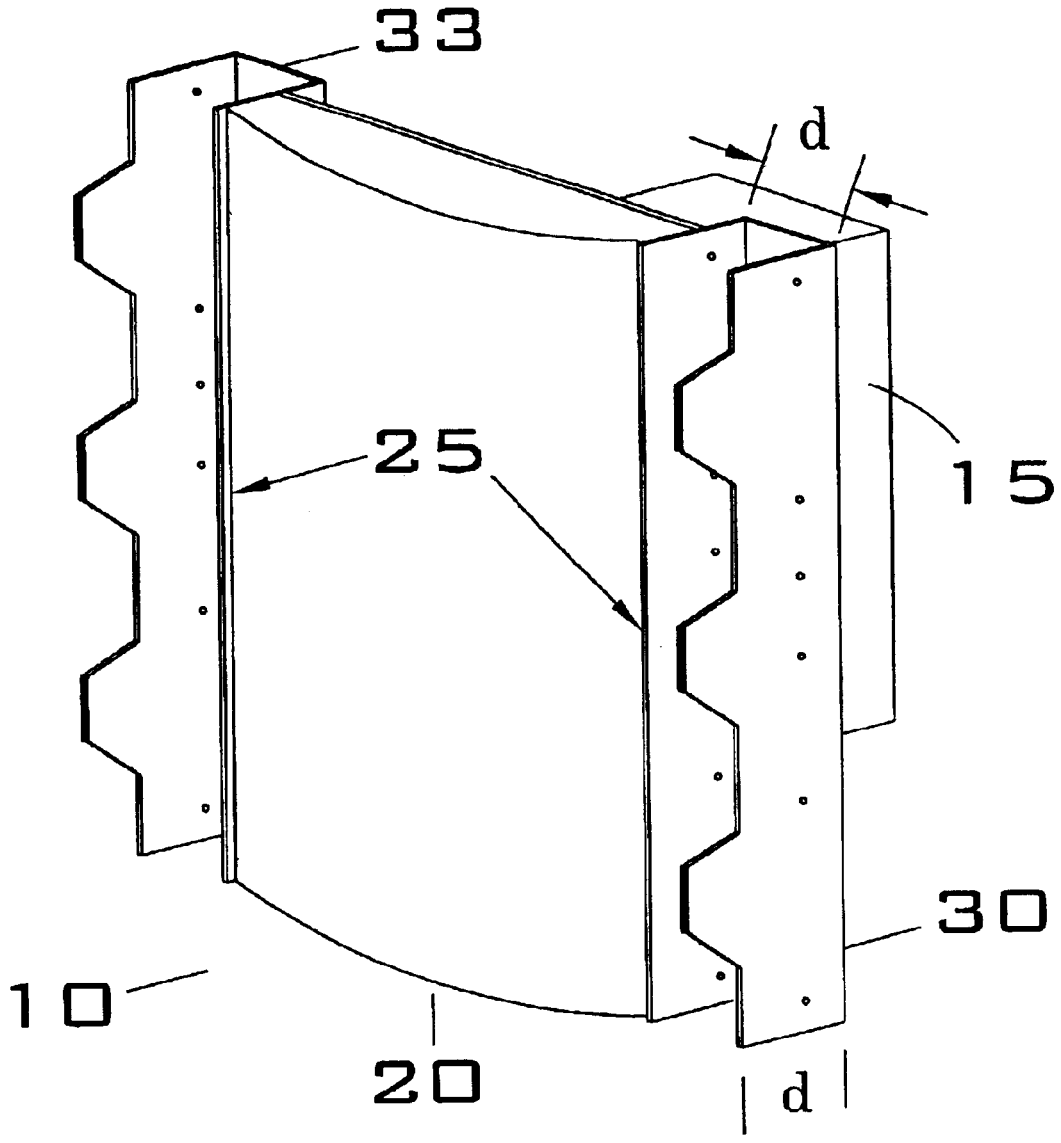
FIG. 1 is a representation of an antenna and isolation shield according to an embodiment of the disclosed subject matter.

FIG. 1 shows an embodiment of the disclosed subject matter. The antenna system 10 includes a radiating portion 20 defined by an outside edge 25, attached to a transmitter 15. Adjacent to the outside edges 25 is an isolation shield formed from a wave guide 30 with a channel width of d as shown. The depth of the channel also advantageously has an equal value of d as well, however, this dimension is less determinative than the width, and thus is of secondary importance.

The antenna system 10 shown in FIG. 1 is a panel antenna, however embodiments with a dish or horn antenna are likewise envisioned and the inclusion of a panel antenna in the figure should not be view as limiting the scope of the disclosed subject matter. The panel antenna of FIG. 1 is a horizontally polarized antenna, as such the waveguides are advantageously adjacent to the side walls, whereas for a vertically polarized antenna, the waveguides would be position adjacent to the upper and/or lower side edges. Additionally while the antenna embodiment discussed herein are for microwave or millimeter wave communication operating at a frequency range of 1–100 GHz, other embodiments operating at other frequencies are likewise envisioned.

Figure 2:
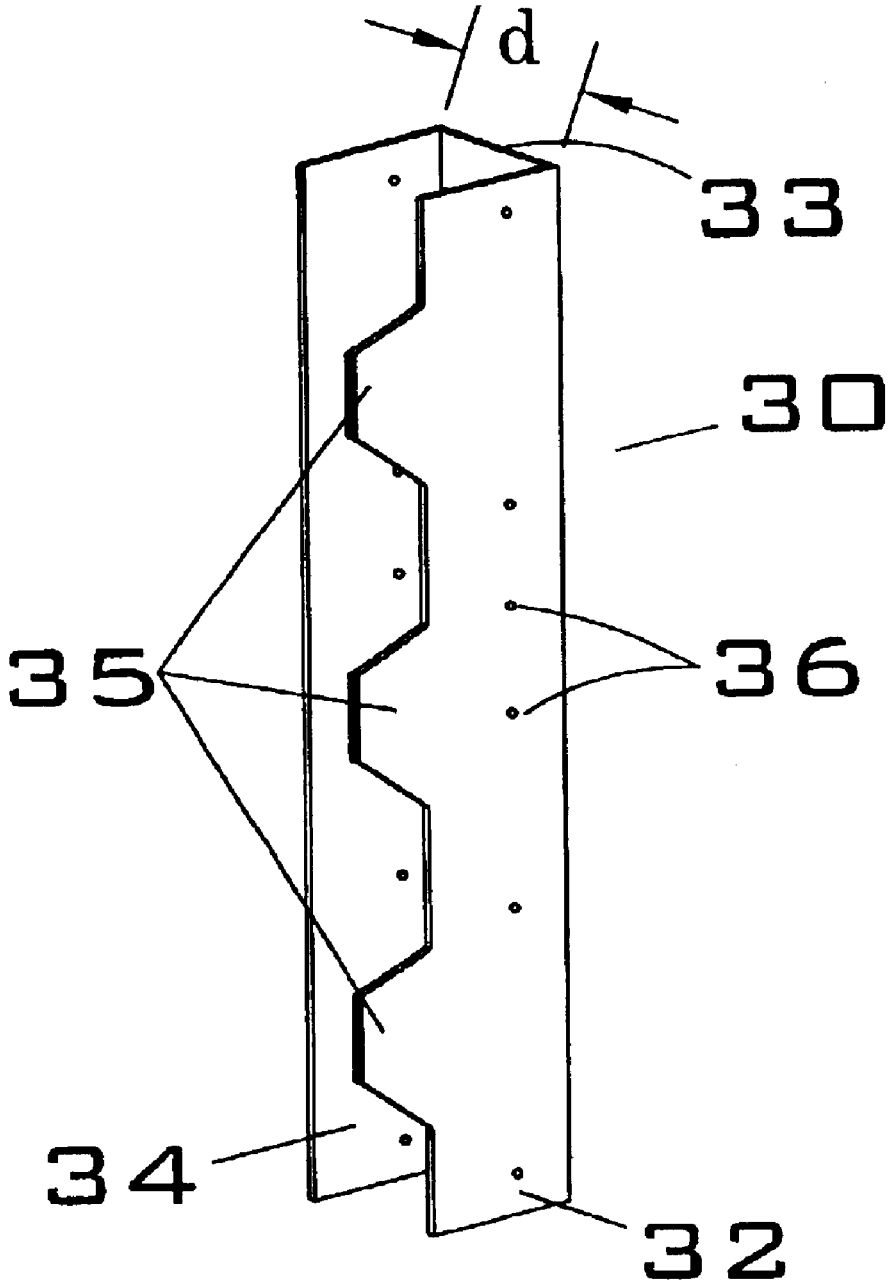
FIG. 2 is a representation of a waveguide according to an embodiment of the discloses subject matter.

FIG. 2 is a representation of the waveguide of FIG. 1. The waveguide 30 is configured to attach to the outside edges 25 of the radiating portion of the antenna 20. The waveguide 30 is dimensioned to create a $TE_{20}$ mode within the channel for the $\lambda$ wavelength wave radiated from the antenna 10. In order to create a $TE_{20}$ mode within the channel the width of dimension d of the waveguide must be a function of $\lambda_{XMT}$, i.e. $d=f(\lambda_{XMT})$. Specifically for creation of the $TE_{20}$ mode the width must satisfy the inequality $1.05\lambda \leqq d \leqq 1.4\lambda$. A dimension d falling outside the inequality on the lower end can excite a $TE_{10}$ mode or if outside the greater side can excite a $TE_{30}$ mode, or other higher order modes.

The waveguide 30 of FIG. 2 is formed with three conductive walls, two parallel side walls 32 and 34 and a back wall 33. The back wall 33 connects the sidewalls 34 and 32 and is perpendicular to the sidewalls. The sidewall 34 may have attachment means, such as brackets, holes or other fastening method which facilitates attachment to the outer edge 25 of the radiating portion 20 of the antenna 10. Alternatively, the waveguide 30 can be an integral member of the antenna 10, or the waveguide can be attached in other manners known in the antenna art. The waveguide may also be configured with radiating tabs 35 or apertures 36 which further serve to tune or otherwise mold the radiation pattern.

Figure 3A:
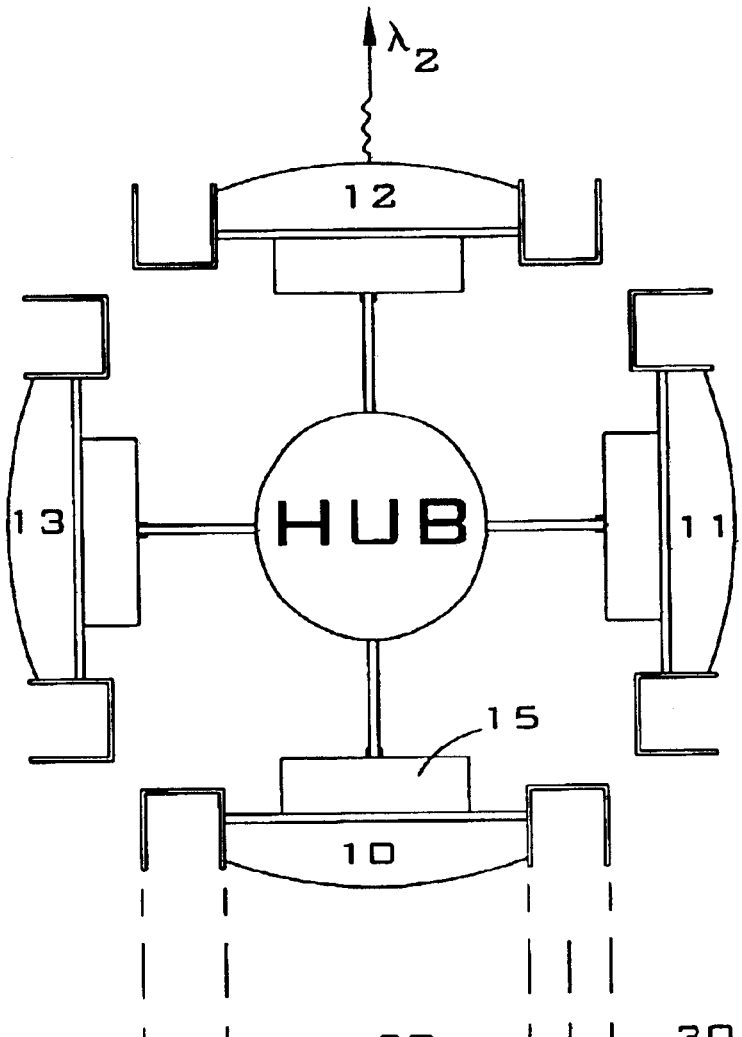
FIG. 3*a* is a representation of an antenna cluster arrangement for a hub.

FIG. 3*a* shows a top view of the antenna 10 shown in FIG. 1 configured with other antennas 11, 12 and 13 in an antenna cluster forming a hub. Typical hub arrangements similar to that shown in FIG. 3*a* are constructed of groups of restricted beam width or directional antennas for each sector of the coverage area. As a group, the sector antennas allow for omni directional transmission coverage of the hub transmission area. These antennas are geometrically pointed to provide an omni-directional composite radiation pattern. However, it is understood that only the number of antenna elements required to communicate with a predetermined number of remote system, rather than an omni directional configuration as shown, may be used, if desired. Typically antenna sector beam widths can be selected from 30, 45, 60, 90 or 180 degrees. The combination of such highly directional antennas with high gain provides for improved frequency reuse and reduces the likelihood of intra cell and inter cell interference. In FIG. 3A, antenna 10 radiates a signal with a wavelength of $\lambda_1$ while antenna 12 radiates a signal with a wavelength of $\lambda_2$. In FIG. 3*a* , the hub configuration shows the sectors or antenna patterns for each of the antenna are set up 90° increments. Other arrangements of antennas and frequencies are also likely and thus envisioned.

Figure 3B:
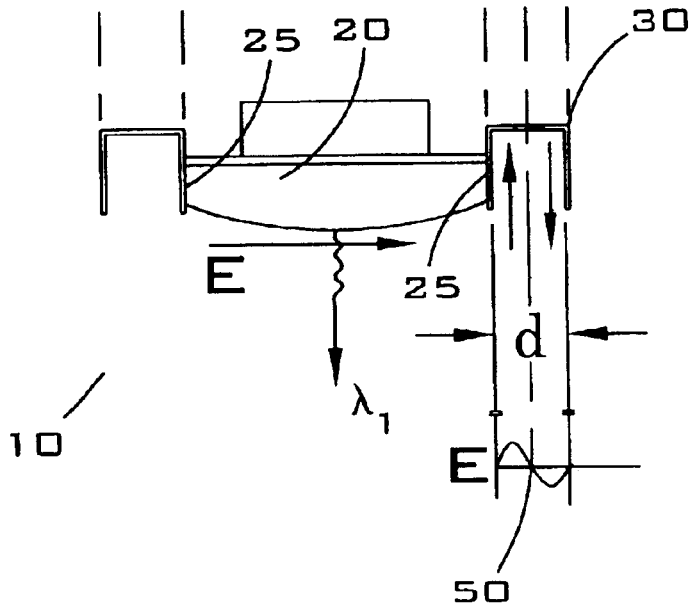
FIG. 3*b* is a representation of an E-field within a waveguide according to an embodiment of the disclosed subject matter.

FIG. 3*b* shows the E-field generated by the radiating portion 20 of the antenna and the leaked E-fields in the waveguide channel created by the waveguide and leakage from the antenna or one or more of the neighboring antenna. Generally, the E-Field for neighboring antenna attenuates around the waveguide. The E-field within the waveguide 30 defined by $\phi$, transitions from a value through zero to an opposite value creating a null 50 in the E-field where $\phi=0$. This null space runs adjacent to the edge 25 of the antenna 10 and thus increases the F/B ratio of the antenna. As discussed previously the width d of the waveguide is $d=f(\lambda_{XMT})$, where $\lambda_{XMT}$ can be $\lambda_1$ or $\lambda_2$. $\lambda_1$ is the $\lambda_{XMT}$ for antenna 10 and $\lambda_2$ is the $\lambda_{XMT}$ for antenna 12 shown in FIG. 3*a*.

Figure 4:
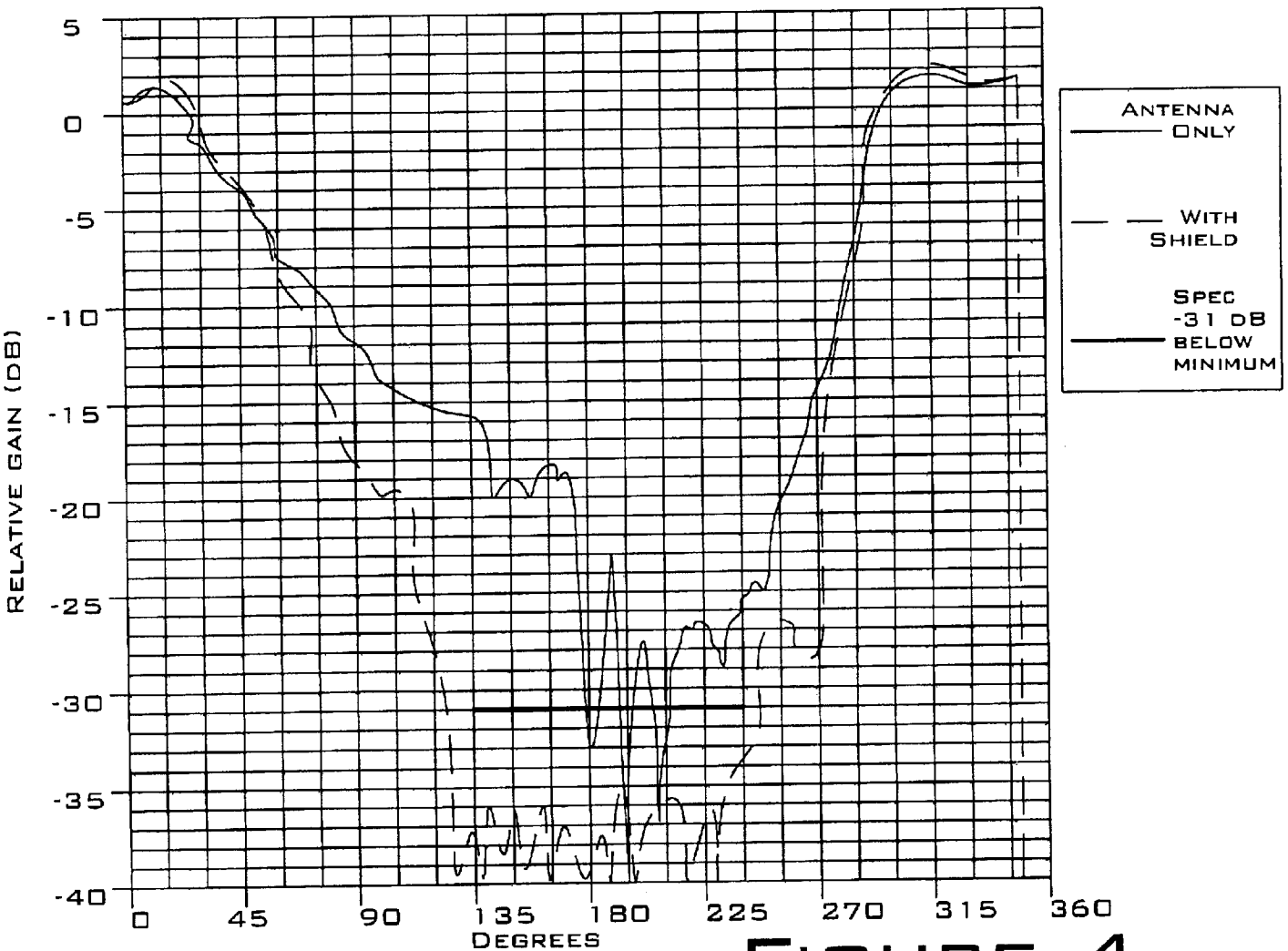
FIG. 4 is a chart demonstrating the effectiveness of an antenna with an isolation shield according to an embodiment of the disclosed subject matter.

FIG. 4 shows a graphical representation of the F/B ratio for an antenna only and the antenna with a shield according to an embodiment of the disclosed subject matter. The graph plots relative gain or attenuation by angular direction, where $\theta=0°$ is directly in front of the antenna and $\theta=180°$ representing directly behind the antenna. As can be seen the F/B ratio for the antenna with an embodiment of the disclosed subject matter for most points is substantially less or better than the antenna alone. Additionally, the embodied shield does not attenuate the signal in the desired direction, $\theta=0°$. The embodied antenna with waveguide accomplishes more than a −31 dB gain for most of the back side of the antenna as shown by the −31 dB threshold.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal thereof.

I claim:

1. An isolation shield for improving F/B ratio for a directional antenna radiating an electromagnetic wave with a wavelength of $\lambda$, comprising:

a waveguide adapted for attachment to at least one side of the directional antenna, said waveguide defining a channel spanning along and positioned adjacent to said at least one side of the directional antenna;

wherein a width of the channel is a function of $\lambda$; and, wherein the channel excites a null E field adjacent to said at least one side, thereby improving the F/B ratio of the directional antenna.

2. The isolation shield of claim 1, wherein the channel width is between 1.05 $\lambda$ and 1.4 $\lambda$.

3. The isolation shield of claim 1, wherein the electromagnetic wave radiated by the directional antenna is horizontally polarized.

4. The isolation shield of claim 1, wherein the electromagnetic wave radiated by the directional antenna is vertically polarized.

5. The isolation shield of claim 1, wherein the electromagnetic wave radiated by the directional antenna has a frequency between 1 and 100 GHz.

6. The isolation shield of claim 1, wherein the directional antenna is a panel antenna.

7. The isolation shield of claim 1, wherein the directional antenna is a horn antenna.

8. The isolation shield of claim 1, wherein the directional antenna is a dish antenna.

9. The isolation shield of claim 1, wherein a depth of the channel is between 1.05 $\lambda$ and 1.4 $\lambda$.

10. The isolation shield of claim 2, wherein a depth of the channel is equal to the width of the channel.

11. The isolation shield of claim 1, wherein the channel spans along parallel to at least a portion of one side of the directional antenna.

12. A directional antenna system configured for radiating a signal at $c/\lambda$ hertz comprising:

a directional antenna defined by an outer edge for radiating the signal;

a waveguide adjacent to at least a portion of the outer edge; said waveguide forming a channel adjacent to the at least a portion of the outer edge; and, wherein the waveguide is dimensioned to excite a $TE_{20}$ mode at a wavelength $\lambda$ within the channel.

13. The directional antenna system of claim 12, the channel having a channel width and a channel depth, said channel width between 1.05 $\lambda$ and 1.4 $\lambda$.

14. The directional antenna system of claim 12, wherein the signal is horizontally polarized.

15. The directional antenna system of claim 12, wherein the signal is vertically polarized.

16. The directional antenna system of claim 12, wherein the signal is between 1 and 100 GHz.

17. The directional antenna system of claim 12, wherein the directional antenna is a panel antenna.

18. The directional antenna system of claim 12, wherein the directional antenna is a horn antenna.

19. The directional antenna system of claim 12, wherein the directional antenna is a dish antenna.

20. The directional antenna system of claim 12, wherein the channel having a channel width and a channel depth, said channel depth between 1.05 $\lambda$ and 1.4 $\lambda$.

21. The directional antenna system of claim 13, wherein the channel depth is equal to the channel width.

22. The directional antenna system of claim 12, wherein the channel defined by the waveguide is parallel to the at least a portion of the outer edge.

23. A method for improving the F/B ratio for a directional antenna with an adjacent waveguide, wherein the directional antenna is configured to radiate a $\lambda$ wavelength signal, the improvement comprising dimensioning the waveguide to excite a $TE_{20}$ mode for the $\lambda$ wavelength signal and creating a null, along an edge of the direction antenna, in an E-field leaked from the antenna, thereby improving the F/B ratio of the directional antenna.

24. The method of claim 23, wherein the waveguide defines a channel, the channel having a channel width and a channel depth, said channel width between 1.05 $\lambda$ and 1.4 $\lambda$.

25. The method of claim 23, wherein the $\lambda$ wavelength signal is horizontally polarized.

26. The method of claim 23, wherein the $\lambda$ wavelength signal is vertically polarized.

27. The method of claim 23, wherein the $\lambda$ wavelength signal is between 1 and 200 GHz.

28. The method of claim 23, wherein the directional antenna is a panel antenna.

29. The method of claim 23, wherein the directional antenna is a horn antenna.

30. The method of claim 23, wherein the directional antenna is a dish antenna.

31. The method of claim 23, wherein the waveguide defines a channel, the channel having a channel width and a channel depth, said channel depth is between 1.05 $\lambda$ and 1.4 $\lambda$.

32. The method of claim 24, wherein the channel depth is equal to the channel width.

33. The method of claim 23, comprising the step of orienting a channel defined by the waveguide parallel to at least a portion of the edge.

34. An antenna cluster having at least two co-located directional antenna systems, one of the at least two co-located antenna systems is configured for radiating a $c/\lambda_1$ hertz signal in one direction and another of the at least two co-located antennas systems is configured for radiating a $c/\lambda_2$ hertz signal in another direction, wherein said one of the at least two co-located antennas systems comprises:

a directional antenna defined by an outer edge;

a waveguide adjacent to at least a portion of the outer edge;

wherein the waveguide is dimensioned to excite a $TE_{20}$ mode at a wavelength $\lambda_2$ within the waveguide.

35. The antenna cluster of claim 34, wherein the waveguide defines a channel, the channel having a channel width and a channel depth, said channel width between 1.05 $\lambda$ and 1.4 $\lambda$.

36. The antenna cluster of claim 34, wherein the signal is horizontally polarized.

37. The antenna cluster of claim 34, wherein the signal is vertically polarized.

38. The antenna cluster of claim 34, wherein the signal is between 1 and 100 GHz.

39. The antenna cluster of claim 34, wherein the directional antenna is a panel antenna.

40. The antenna cluster of claim 34, wherein the directional antenna is a horn antenna.

41. The antenna cluster of claim 34, wherein the directional antenna is a dish antenna.

42. The antenna cluster of claim 34, wherein the waveguide defines a channel, the channel having a channel width and a channel depth, said channel depth is between 1.05 $\lambda$ and 1.4 $\lambda$.

43. The antenna cluster of claim 35, wherein the channel depth is equal to the channel width.

44. The antenna cluster of claim 34, wherein a channel defined by the waveguide is parallel to at least a portion of the outer edge.

45. A directional antenna system configured for radiating a horizontally polarized signal with at $c/\lambda$ hertz comprising:

a directional panel antenna defined by an outer edge for radiating the signal, said outer edge formed by two side edges, a top edge and a bottom edge a waveguide adjacent one of the two side edges; said waveguide forming a channel parallel to said one of the two side edges; wherein the waveguide is dimensioned to excite a $TE_{20}$ mode within said channel for a $\lambda$ wavelength.

46. The directional antenna system of claim 45, wherein said channel is defined by a first second and third conductive surfaces, said first and second conductive surfaces parallel to each other and perpendicular to the third conductive surface.

47. The directional antenna system of claim 45, wherein a channel width is between 1.05 $\lambda$ and 1.4 $\lambda$.

48. The directional antenna system of claim 45, wherein a channel depth is between 1.05 $\lambda$ and 1.4 $\lambda$.

49. The directional antenna system of claim 47, wherein a channel depth and the channel width are approximately equal.

50. The directional antenna system of claim 45, wherein the signal is between 1 and 100 GHz.

* * * * *